US011143979B2

(12) United States Patent
Shimizu et al.

(10) Patent No.: US 11,143,979 B2
(45) Date of Patent: Oct. 12, 2021

(54) IMAGE FORMING APPARATUS HAVING SIMPLE CONFIGURATION AND CAPABLE OF MEASURING TONER CURRENT INCLUDED IN DEVELOPING CURRENT, AND ACCURATELY CALCULATING TONER CHARGE AMOUNT BASED ON MEASUREMENT RESULT

(71) Applicant: KYOCERA Document Solutions Inc., Osaka (JP)

(72) Inventors: Tamotsu Shimizu, Osaka (JP); Mitsuhiro Hashimoto, Osaka (JP); Takahiro Okubo, Osaka (JP); Yohei Wakasa, Osaka (JP); Kazuhiro Nakachi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/098,406

(22) Filed: Nov. 15, 2020

(65) Prior Publication Data

US 2021/0149321 A1 May 20, 2021

(30) Foreign Application Priority Data

Nov. 15, 2019 (JP) ..... JP2019-206955

(51) Int. Cl.
*G03G 15/06* (2006.01)

(52) U.S. Cl.
CPC ..... *G03G 15/065* (2013.01)

(58) Field of Classification Search
CPC ..... G03G 15/0266; G03G 15/065; G03G 15/0907; G03G 15/1675; G03G 15/5041; G03G 15/556
USPC ..... 399/38, 49, 53, 55
See application file for complete search history.

(56) References Cited

U.S. PATENT DOCUMENTS

| | | | | |
|---|---|---|---|---|
| 9,841,700 | B2 * | 12/2017 | Kato | G03G 15/065 |
| 10,295,930 | B2 * | 5/2019 | Shiraishi | G03G 15/065 |
| 10,394,155 | B2 * | 8/2019 | Miyamoto | G03G 15/0266 |
| 10,545,425 | B2 * | 1/2020 | Makino | G03G 15/5004 |
| 2003/0219266 | A1 | 11/2003 | Itagaki et al. | |

FOREIGN PATENT DOCUMENTS

| | | |
|---|---|---|
| JP | 2003-345075 A | 12/2003 |
| JP | 2009-294504 A | 12/2009 |
| JP | 2010-019969 A | 1/2010 |

* cited by examiner

*Primary Examiner* — Hoan H Tran
(74) *Attorney, Agent, or Firm* — Hawaii Patent Services; Nathaniel K. Fedde; Kenton N. Fedde

(57) ABSTRACT

Provided is an image forming apparatus having a simple configuration capable of measuring a toner current included in a developing current and accurately calculating a toner charge amount based on the measurement result. A developing device has a developer carrier that carries a two-component developer including a magnetic carrier and toner. A developing voltage power supply applies a developing voltage obtained by superimposing an AC voltage on a DC voltage on the developer carrier. A control unit estimates a toner charge amount based on a toner current calculated by subtracting a carrier current from a developing current detected by a current detecting unit when a reference image is formed during non-image formation, and a toner developing amount calculated from the density of a reference image detected by a density detecting device.

6 Claims, 6 Drawing Sheets

IMAGE FORMING APPARATUS HAVING SIMPLE CONFIGURATION AND CAPABLE OF MEASURING TONER CURRENT INCLUDED IN DEVELOPING CURRENT, AND ACCURATELY CALCULATING TONER CHARGE AMOUNT BASED ON MEASUREMENT RESULT

INCORPORATION BY REFERENCE

This application is based on and claims the benefit of priority from Japanese Patent Application No. 2019-206955 filed on Nov. 15, 2019, the contents of which are hereby incorporated by reference.

BACKGROUND

The present disclosure relates to an image forming apparatus such as a copier, a printer, a facsimile, a multifunction apparatus of these, and the like that are provided with an image carrier, and more particularly, related to an image forming apparatus that accurately measures the toner charge amount in a developing method that uses a two-component developer that includes a toner and a carrier.

In a developing method using a two-component developer including a magnetic carrier and toner, the developer is affected by the number of prints, environmental (temperature and humidity) fluctuations, print mode, print rate on the image (ratio of the area to be printed to the area where an image can be formed) and the like and deteriorates, and the charging characteristics of the toner in the developer change. As a result, the toner cannot be sufficiently charged, and problems such as a decrease in image density, image fogging, toner scattering and the like occur.

Therefore, conventionally, a change in the amount of toner charged is predicted based on the number of prints, environmental changes, printing modes, printing rates, and the like. Then, based on the prediction result, the toner concentration, the developing voltage, the surface potential of the photoconductor, the rotation speed of the developing roller, the output of the fan that sucks the scattered toner, and the like are adjusted to suppress a reduction in the image density, and suppress image fogging, and toner scattering.

However, these methods are merely a combination of prediction from the number of prints, and prediction under each condition of environmental change, print mode, and print rate, and in a case where the number of prints, environmental fluctuation, print mode, print rate, and the like is changed in a complex manner, the amount of charge of the toner may not be predicted accurately.

Therefore, a method of directly calculating the toner charge amount has been proposed. For example, in a typical technique, there is an image forming apparatus in which the surface potential of the drum before development and the surface potential of the toner layer after development are measured, the toner developing amount is obtained from the image density of the toner layer, and the toner developing amount is found from the surface potentials of the drum and toner layer and the toner charge amount.

Moreover, in another typical technique there is an image forming apparatus capable of executing a first mode and a second mode. In the first mode, a toner image is formed based on image data for printing. In the second mode, a patch image is formed based on patch image data, and the charge amount of the toner is measured based on the density of the patch image and the developing current. Furthermore, in another typical technique, the amount of adhesion of the image formed on the image carrier is changed. Together with this, there is an image forming apparatus that calculates the toner charge amount. This is based on the amount of change in the developing current detected by a current detecting method according to the change in an image formed on the image carrier and the amount of change in the amount of adhering of the developer detected by a adhering amount detecting method.

SUMMARY

In order to accomplish the object described above, a first configuration according to the present disclosure is an image forming apparatus that includes: an image forming unit that includes an image carrier, a charging device, an exposing device, and a developing device; a developing voltage power supply; a density detecting device; a current detecting unit; and a control unit. A photosensitive layer is formed on the surface of the image carrier. The charging device charges the image carrier. An exposing device forms an electrostatic latent image by exposing the image carrier charged by the charging device. The developing device has a developer carrier arranged facing the image carrier and carrying a two-component developer that includes a magnetic carrier and toner, and forms a toner image by adhering the toner to the electrostatic latent image formed on the image carrier. The developing voltage power supply applies a developing voltage obtained by superimposing an AC voltage on a DC voltage on the developer carrier; The density detecting device detects the density of the toner image formed by the developing device. The current detecting unit detects a DC component of a developing current that flows when a developing voltage is applied to the developer carrier. The control unit controls the image forming unit and the developing voltage power supply. The control unit, by the developing device at a time of non-image formation, forms a reference image on the image carrier; by a current detecting unit, detects the developing current when the reference image is formed; and calculates a toner current flowing due to movement of the toner by subtracting a carrier current flowing through the carrier from the detected developing current. The control unit, from the density of a reference image detected by a density detecting device, calculates the toner developing amount when a reference image is formed, and estimates the toner charge amount based on the toner current and the toner developing amount.

DETAILED DESCRIPTION

Figure 1:
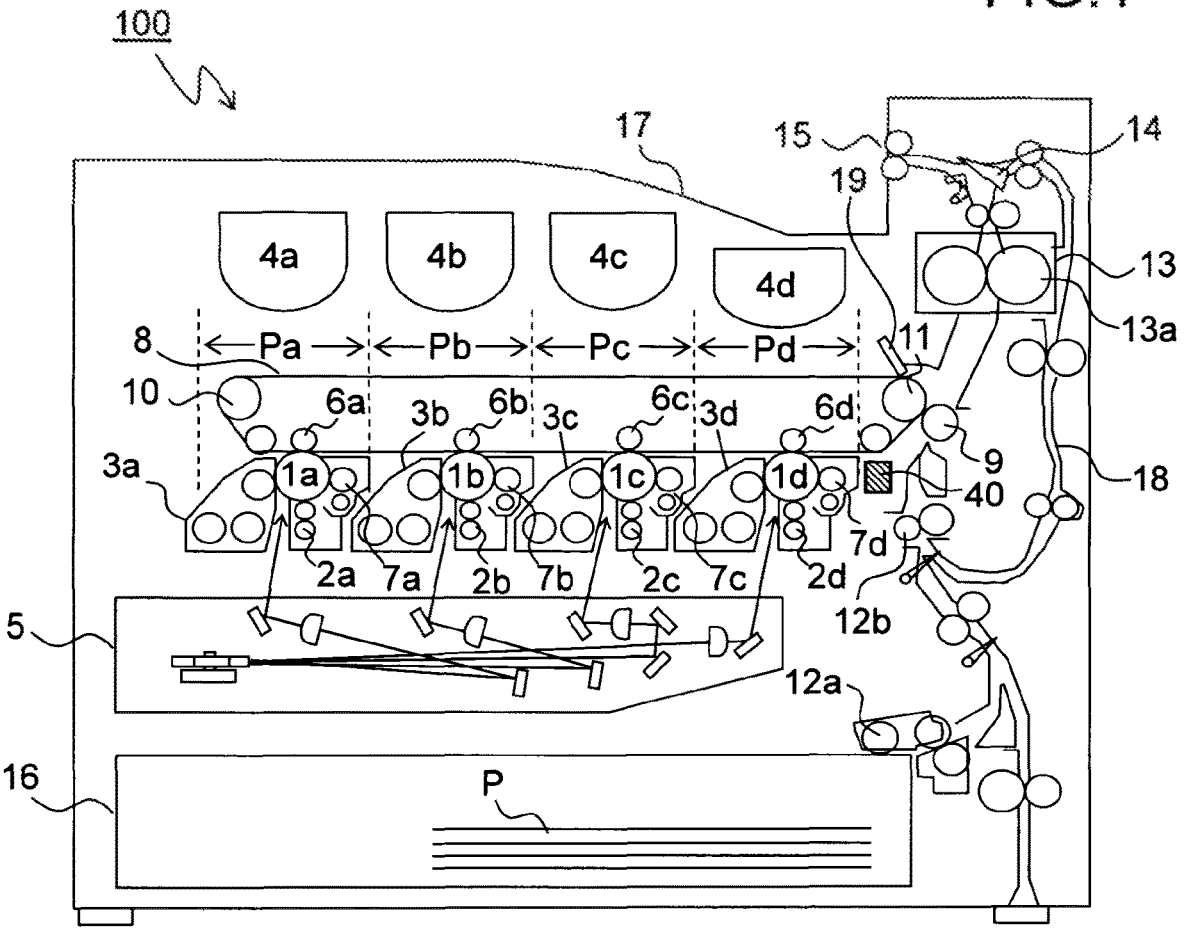
FIG. 1 is a side cross-sectional view illustrating an internal configuration of an image forming apparatus 100 of an embodiment according to the present disclosure.

Hereinafter, embodiments according to the present disclosure will be described with reference to the drawings. FIG. 1 is a cross-sectional view illustrating an internal configuration of an image forming apparatus 100 of an embodiment according to the present disclosure. In the main body of the image forming apparatus 100 (a color printer in this case), four image forming units Pa, Pb, Pc and Pd are arranged in order from the upstream side in the conveying direction (left side in FIG. 1). These image forming units Pa to Pd are provided so as to correspond to images of four different colors (cyan, magenta, yellow, and black), and through each step of charging, exposing, developing and transferring, the image forming units Pa to Pd sequentially form cyan, magenta, yellow, and black images, respectively.

Photoconductor drums (image carriers) 1*a*, 1*b*, 1*c* and 1*d* that carry visible images (toner images) of each color are arranged in these image forming units Pa to Pd. Furthermore, an intermediate transfer belt (intermediate transfer body) 8 that is rotated in the counterclockwise direction in FIG. 1 by a drive unit is provided adjacent to each of the image forming units Pa to Pd. The toner images formed on the photoconductor drums 1*a* to 1*d* are primarily transferred and superimposed sequentially on the intermediate transfer belt 8 that moves while coming in contact with each of the photoconductor drums 1*a* to 1*d*. After that, the toner images that have been primarily transferred onto the intermediate transfer belt 8 are secondarily transferred by a secondary transfer roller 9 onto transfer paper P as an example of a recording medium. Furthermore, the transfer paper P on which the toner images have been secondarily transferred is discharged from the main body of the image forming apparatus 100 after the toner images are fixed by a fixing unit 13. An image forming process for each of the photoconductor drums 1*a* to 1*d* is executed while rotating the photoconductor drums 1*a* to 1*d* in the clockwise direction in FIG. 1.

The transfer paper P on which the toner images will be secondarily transferred is housed in a paper cassette 16 arranged in the lower part of the main body of the image forming apparatus 100. Then, the transfer paper P is conveyed via a paper supply roller 12*a* and a registration roller pair 12*b* to a nipping part between the secondary transfer roller 9 and the drive roller 11 of the intermediate transfer belt 8. A sheet made of a dielectric resin is used for the intermediate transfer belt 8, and a belt having no seams (seamless) is mainly used. Moreover, a blade-shaped belt cleaner 19 for removing toner and the like remaining on the surface of the intermediate transfer belt 8 is arranged on the downstream side of the secondary transfer roller 9.

Next, the image forming units Pa to Pd will be described. Charging devices 2*a*, 2*b*, 2*c* and 2*d*, an exposing device 5, developing devices 3*a*, 3*b*, 3*c* and 3*d*, and cleaning devices 7*a*, 7*b*, 7*c* and 7*d* are provided around and below the rotatably arranged photoconductor drums 1*a* to 1*d*. The charging devices 2*a*, 2*b*, 2*c* and 2*d* charge the photoconductor drums 1*a* to 1*d*. The exposing device 5 exposes image information on the photoconductor drums 1*a* to 1*d*. The developing devices 3*a*, 3*b*, 3*c* and 3*d* form toner images on the photoconductor drums 1*a* to 1*d*. The cleaning devices 7*a*, 7*b*, 7*c* and 7*d* remove developer (toner) and the like remaining on the photoconductor drums 1*a* to 1*d*.

When image data is inputted from a host apparatus such as a personal computer or the like, first, the surfaces of the photoconductor drums 1*a* to 1*d* are uniformly charged by the charging devices 2*a* to 2*d*. Next, the exposing device 5 irradiates light according to the image data to form electrostatic latent images corresponding to image data on the photoconductor drums 1*a* to 1*d*. The developing devices 3*a* to 3*d* are filled with a specific amount of a two-component developer including each color toners of cyan, magenta, yellow, and black, respectively. Note that in a case where the ratio of toner in the two-component developer that is filled in each of the developing devices 3*a* to 3*d* falls below a specified value due to the formation of the toner images described later, toner is supplied to each of the developing devices 3*a* to 3*d* from toner containers 4*a* to 4*d*. The toner in the developer is supplied onto the photoconductor drums 1*a* to 1*d* by the developing devices 3*a* to 3*d*, and toner images corresponding to the electrostatic latent images formed by exposure from the exposing device 5 are formed by toner electrostatically adhering to the photoconductor drums 1*a* to 1*d*.

Then, an electric field is applied between primary transfer rollers 6*a* to 6*d* and the photoconductor drums 1*a* to 1*d* at a specific transfer voltage by the primary transfer rollers 6*a* to 6*d*, and cyan, magenta, yellow and black toner images on the photoconductor drums 1*a* to 1*d* are primarily transferred onto the intermediate transfer belt 8. These four-color images are formed with a specific positional relationship specified in advance for the formation of a specific full-color image. After that, in preparation for the subsequent formation of new electrostatic latent images, the toner and the like remaining on the surfaces of the photoconductor drums 1*a* to 1*d* after the primary transfer are removed by the cleaning devices 7*a* to 7*d*.

The intermediate transfer belt 8 is suspended around a driven roller 10 on the upstream side and the drive roller 11 on the downstream side. As the drive roller 11 is rotated by a drive motor, the intermediate transfer belt 8 starts rotating in the counterclockwise direction. Then, the transfer paper P is conveyed at a specific timing from the registration roller pair 12*b* to the nipping part (secondary transfer nipping part) between the drive roller 11 and the adjacently provided secondary transfer roller 9. Then, the full-color image on the intermediate transfer belt 8 is secondarily transferred onto the transfer paper P. The transfer paper P on which the toner image is secondarily transferred is conveyed to a fixing unit 13.

The transfer paper P conveyed to the fixing unit 13 is heated and pressurized by a fixing roller pair 13*a* to fix the toner image on the surface of the transfer paper P, and a specific full-color image is formed. The transfer paper P on which the full-color image is formed is distributed in the conveying direction by branching portions 14 branched in a plurality of directions, and then is discharged as is (or after being sent to a double-sided conveying path 18 and an image is formed on both sides) to a discharge tray 17 by a discharge roller pair 15.

Furthermore, an image density sensor 40 is arranged at a position facing the drive roller 11 with the intermediate transfer belt 8 interposed therebetween. As the image density sensor 40, an optical sensor including a light emitting element made of an LED or the like and a light receiving element made of a photodiode or the like are generally used. When measuring the amount of toner adhering on the intermediate transfer belt 8, a measurement light is irradiated from a light emitting element onto each reference image formed on the intermediate transfer belt 8, and that measurement light enters into a light receiving element as light that is reflected by the toner and light that is reflected by the belt surface.

The reflected light from the toner and the belt surface includes specularly reflected light and diffusely reflected light. The specularly reflected light and the diffusely reflected light are separated by a polarized light separating prism and then enters into separate light receiving elements, respectively. Each light receiving element photoelectrically converts the specularly reflected light and the diffusely reflected light that is received and outputs an output signal to a main control unit 80 (see FIG. 3). Then, the toner amount is detected from the characteristic change of the output signals of the specularly reflected light and the diffusely reflected light, and density correction (calibration) is performed for each color by adjusting the characteristic value of the developing voltage or the like in comparison with a reference density that is specified in advance.

Figure 2:
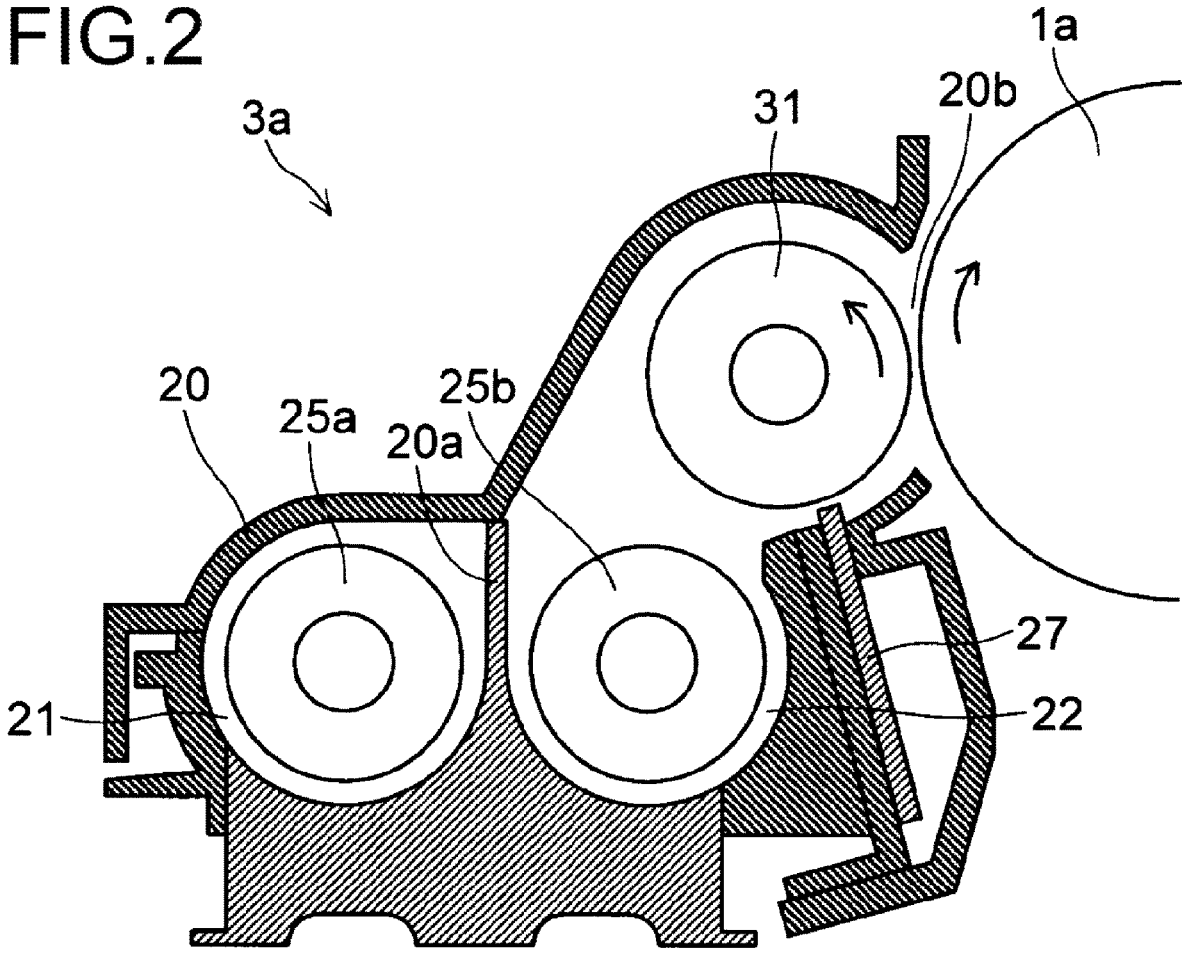
FIG. 2 is a side cross-sectional view of a developing device 3*a* mounted in an image forming apparatus 100.

FIG. 2 is a side cross-sectional view of a developing device 3*a* mounted in an image forming apparatus 100. Note that in the following description, an example of a developing device 3*a* arranged in the image forming unit Pa of FIG. 1 is illustrated; however, the configuration of the developing devices 3*b* to 3*d* arranged in the image forming units Pb to Pd is basically the same, so a description is omitted.

As illustrated in FIG. 2, the developing device 3*a* includes a developing container 20 in which a two-component developer that includes a magnetic carrier and toner (hereinafter, simply referred to as a developer) is stored, and the developing container 20 is divided by a partition wall 20*a* into a stirring conveying chamber 21 and a supply conveying chamber 22. In the stirring conveying chamber 21 and the supply conveying chamber 22, a stirring conveyor screw 25*a* and a supply conveyor screw 25*b* for mixing, stirring and charging the toner supplied from the toner container 4*a* (see FIG. 1) with a magnetic carrier are rotatably arranged, respectively.

Then, the developer is conveyed in the axial direction (direction perpendicular to the paper surface of FIG. 2) while being stirred by the stirring conveyor screw 25*a* and the supply transfer screw 25*b*, and circulates between the stirring conveying chamber 21 and the supply conveying chamber 22 via developer passage paths formed at both end portions of the partition wall 20*a*. In other words, a circulation path for the developer is formed in the developing container 20 by the stirring conveying chamber 21, the supply conveying chamber 22, and the developer passage paths.

The developing container 20 extends diagonally upward to the right in FIG. 2, and a developing roller 31 is arranged diagonally upward to the right of the supply conveyor screw 25*b* in the developing container 20. Then, a part of the outer peripheral surface of the developing roller 31 is exposed from the opening portion 20*b* of the developing container 20 and faces the photoconductor drum 1*a*. The developing roller 31 rotates in the counterclockwise direction in FIG. 2.

The developing roller 31 includes a cylindrical developing sleeve that rotates in the counterclockwise direction in FIG. 2 and a magnet having a plurality of magnetic poles fixed inside the developing sleeve. Note that although a developing sleeve having a knurled surface is used here, the following may also be used. A developing sleeve with many concave shapes (dimples) formed on the surface or a blasted surface, and furthermore a developing sleeve processed by blasting in addition to knurling and concave shape formation, and a developing sleeve processed by plating treatment may also be used.

Moreover, a regulating blade 27 is attached to the developing container 20 along the longitudinal direction of the developing roller 31 (perpendicular to the paper surface of FIG. 2). A slight gap is formed between the tip-end portion of the regulating blade 27 and the surface of the developing roller 31.

A developing voltage including a DC voltage Vslv (DC) (hereinafter, also referred to as Vdc) and an AC voltage Vslv (AC) is applied to the developing roller 31 by a developing voltage power supply 43 (see FIG. 3).

Figure 3:
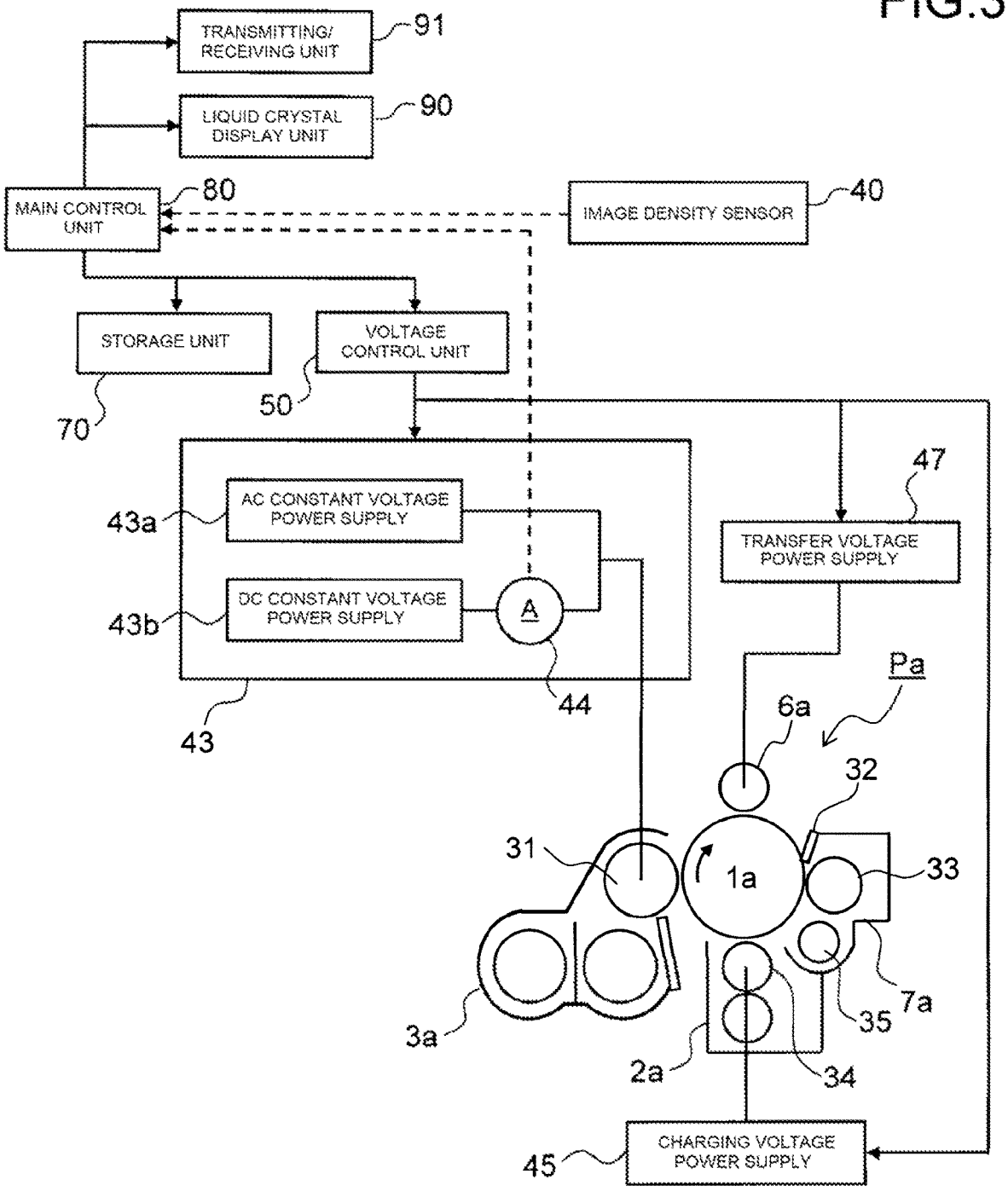
FIG. 3 is a partial enlarged view of the surroundings of an image forming unit Pa including the control path of the developing device 3*a*.

FIG. 3 is a partial enlarged view of the surroundings of an image forming unit Pa including the control path of the developing device 3*a*. In the following description, the configuration of the image forming unit Pa and the control path of the developing device 3*a* will be described; however, the same applies to the configurations of the image forming units Pb to Pd and the control paths of the developing devices 3*b* to 3*d*, and thus the descriptions thereof will be omitted.

The developing roller 31 is connected to the developing voltage power supply 43 that generates an oscillation voltage in which a DC voltage and an AC voltage are superimposed. The developing voltage power supply 43 includes an AC constant voltage power supply 43*a* and a DC constant voltage power supply 43*b*. The AC constant voltage power supply 43*a* outputs a sinusoidal AC voltage generated from a low-voltage DC voltage modulated into a pulse form using a step-up transformer. The DC constant voltage power supply 43*b* outputs a DC voltage obtained by rectifying a sinusoidal AC voltage generated from a low-voltage DC voltage modulated into a pulse form using a step-up transformer.

The developing voltage power supply 43 outputs a developing voltage obtained by superimposing an AC voltage on a DC voltage from the AC constant voltage power supply 43*a* and the DC constant voltage power supply 43*b* at the time of image formation. A current detecting unit 44 detects the DC current value flowing between the developing roller 31 and the photoconductor drum 1*a*.

The charging voltage power supply 45 applies a charging voltage in which an AC voltage is superimposed on a DC voltage to a charging roller 34 of the charging device 2*a*. The configuration of the charging voltage power supply 45 is the same as that of the developing voltage power supply 43. The transfer voltage power supply 47 applies a primary transfer voltage and a secondary transfer voltage to the primary transfer rollers 6*a* to 6*d* and the secondary transfer roller 9 (see FIG. 1), respectively.

The cleaning device 7*a* includes a cleaning blade 32, a rubbing roller 33, and a conveying spiral 35. The cleaning blade 32 removes remaining toner on the surface of the photoconductor drum 1*a*. The rubbing roller 33 removes remaining toner on the surface of the photoconductor drum 1*a* and rubs and polishes the surface of the photoconductor drum 1*a*. The conveying spiral 35 discharges the remaining toner removed from the photoconductor drum 1*a* by the cleaning blade 32 and the rubbing roller 33 to the outside of the cleaning device 7*a*.

Next, the control system of the image forming apparatus 100 will be described with reference to FIG. 3. The image forming apparatus 100 is provided with a main control unit 80 composed of a CPU or the like. The main control unit 80 is connected to a storage unit 70 including a ROM, a RAM, or the like. The main control unit 80 controls each part of the image forming apparatus 100 (charging devices 2*a* to 2*d*, developing devices 3*a* to 3*d*, exposing device 5, primary transfer rollers 6*a* to 6*d*, cleaning devices 7*a* to 7*d*, secondary transfer roller 9, fixing unit. 13, developing voltage power supply 43, the current detecting unit 44, charging voltage power supply 45, transfer voltage power supply 47, voltage control unit 50, and the like). This is based on a control program and control data stored in the storage unit 70.

The voltage control unit 50 controls the developing voltage power supply 43 that applies a developing voltage to the developing roller 31, the charging voltage power supply 45 that applies a charging voltage to the charging roller 34, and the transfer voltage power supply 47 that applies a transfer voltage to the primary transfer rollers 6*a* to 6*d* and the secondary transfer roller 9. Note that the voltage control unit 50 may be configured by a control program stored in the storage unit 70.

A liquid crystal display unit 90 and a transmitting/receiving unit 91 are connected to the main control unit 80. The liquid crystal display unit 90, together with functioning as a touch panel for the user to perform various settings of the image forming apparatus 100, displays the state of the image forming apparatus 100, the image forming status, the number of prints, and the like. The transmitting/receiving unit 91 communicates with the outside using a telephone line or an Internet line.

As described above, when the amount of charge of the toner in the developer changes, problems such as a decrease in image density, image fogging, toner scattering and the like occur. In the image forming apparatus 100 of the present embodiment, the toner current is accurately measured by subtracting the carrier current from the developing current flowing between the developing roller 31 and the photoconductor drums 1*a* to 1*d* at the time of image formation, and the toner charge amount is calculated based on the toner current. Hereinafter, a method for calculating the toner charge amount, which is a feature of the present disclosure, will be described.

The developing current is the sum of the carrier current flowing through the carrier and the toner current flowing due to the movement of the toner. Taking the developing current to be Id [μA], the carrier current to be Ic [μA], and the toner current to be It [μA], the developing current is expressed as Id=Ic+It. In other words, Id=Ic in the non-exposed portion (white background portion) where the toner does not move.

Moreover, the surface potentials of the photoconductor drums 1*a* to 1*d* of the non-exposed portion (white background portion) and the exposed portion (image portion) are V0 and VL, respectively, and the DC component of the developing voltage applied to the developing roller 31 is Vdc. At this time, the potential difference (developing potential difference) between the developing roller 31 and the photoconductor drums 1*a* to 1*d* in the non-exposed portion (white background portion) and the exposed portion (image portion) is represented by V0−Vdc and Vdc−VL, respectively.

The carrier current Ic depends on the developing potential difference, so the correlation between the developing current Id (=carrier current Ic) in the non-exposed portion (white background portion) and the developing potential difference V0−Vdc is acquired. Then, the developing current Id corresponding to the developing potential difference Vdc−VL in the exposed portion (image portion) is calculated from the acquired correlation. The calculated developing current Id is presumed to be the carrier current Ic that flows during image formation, and is used in the calculation of the toner current It.

Figure 4:
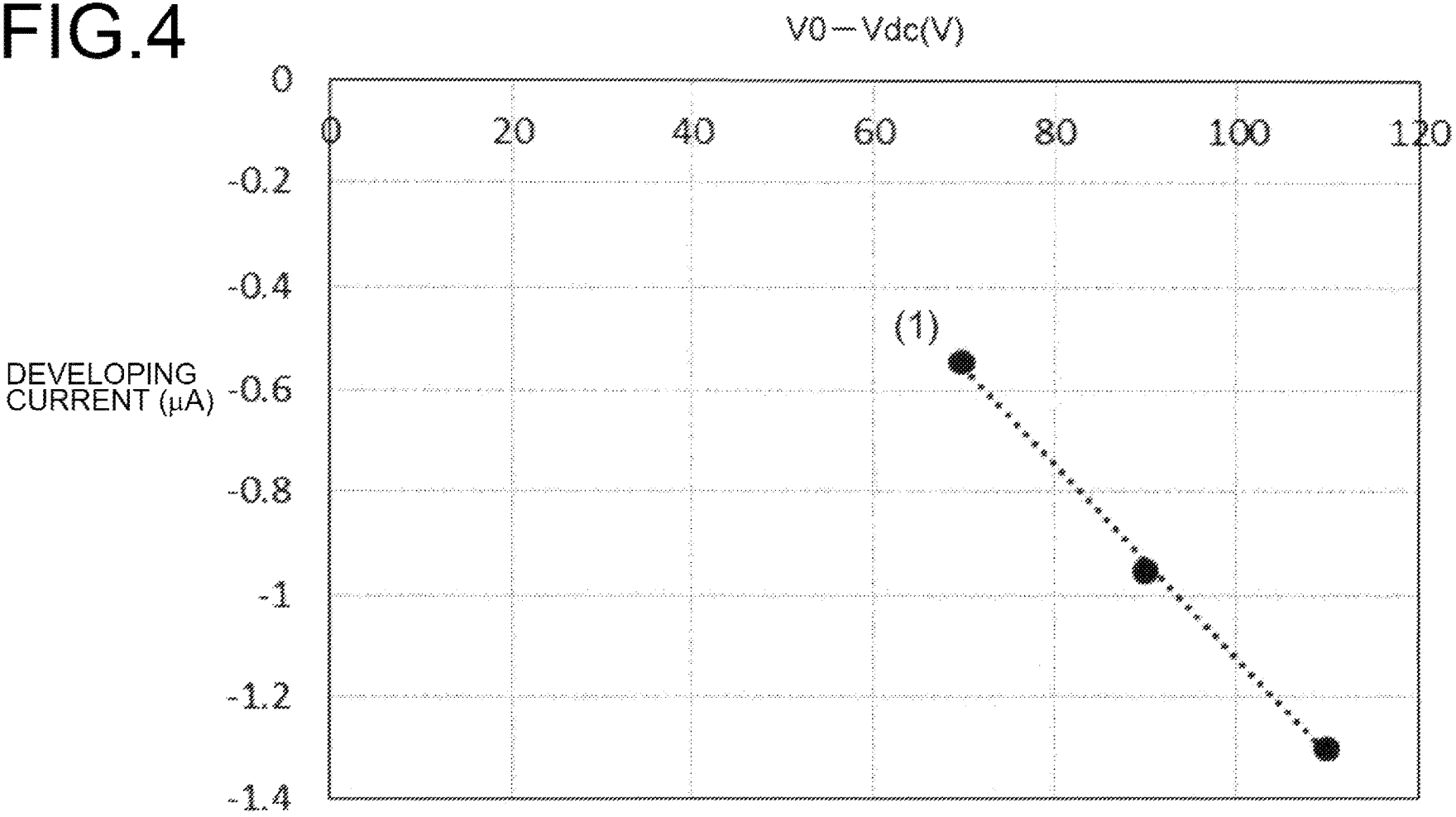
FIG. 4 is a graph illustrating the developing current Id that flows when the developing potential difference V0−Vdc between a non-exposed portion (white background portion) potential V0 and the DC component Vdc of the developing voltage is changed in a plurality of steps.

More specifically, as illustrated in FIG. 4, the development current Id that flows when the developing potential difference V0−Vdc in the non-exposed portion (white background portion) is changed in a plurality of steps is acquired, and based on the acquisition result, the change of the developing current Id with respect to V0−Vdc is acquired. The surface potential V0 of the non-exposed portion (white background portion) is higher than the developing voltage Vdc, so the developing current (=carrier current Ic) flows from the photoconductor drums 1*a* to 1*d* side to the developing roller 31 side. Therefore, the developing current Id detected by the current detecting unit 44 becomes negative. The change in the developing current Id with respect to V0−Vdc is represented by the Approximation Equation (1) indicated by the dotted line in FIG. 4.

$$y=-0.0189x+0.7665 \quad (1)$$

Note that in the actual calculation, it is necessary to calculate the amount of current per unit area [μA/cm2] by dividing the developing current by the measured area. In addition, the developing current is measured a plurality of times, and by using the average value of each of the measured values, the error becomes small.

Next, the surfaces of the photoconductor drums 1*a* to 1*d* are exposed by the exposing device 5 to form an electrostatic latent image pattern of the reference image. Then, the image portion (exposed portion) is developed by the developing devices 3*a* to 3*d*, and the developing current Id flowing during development and the density of the reference image are measured.

Figure 5:
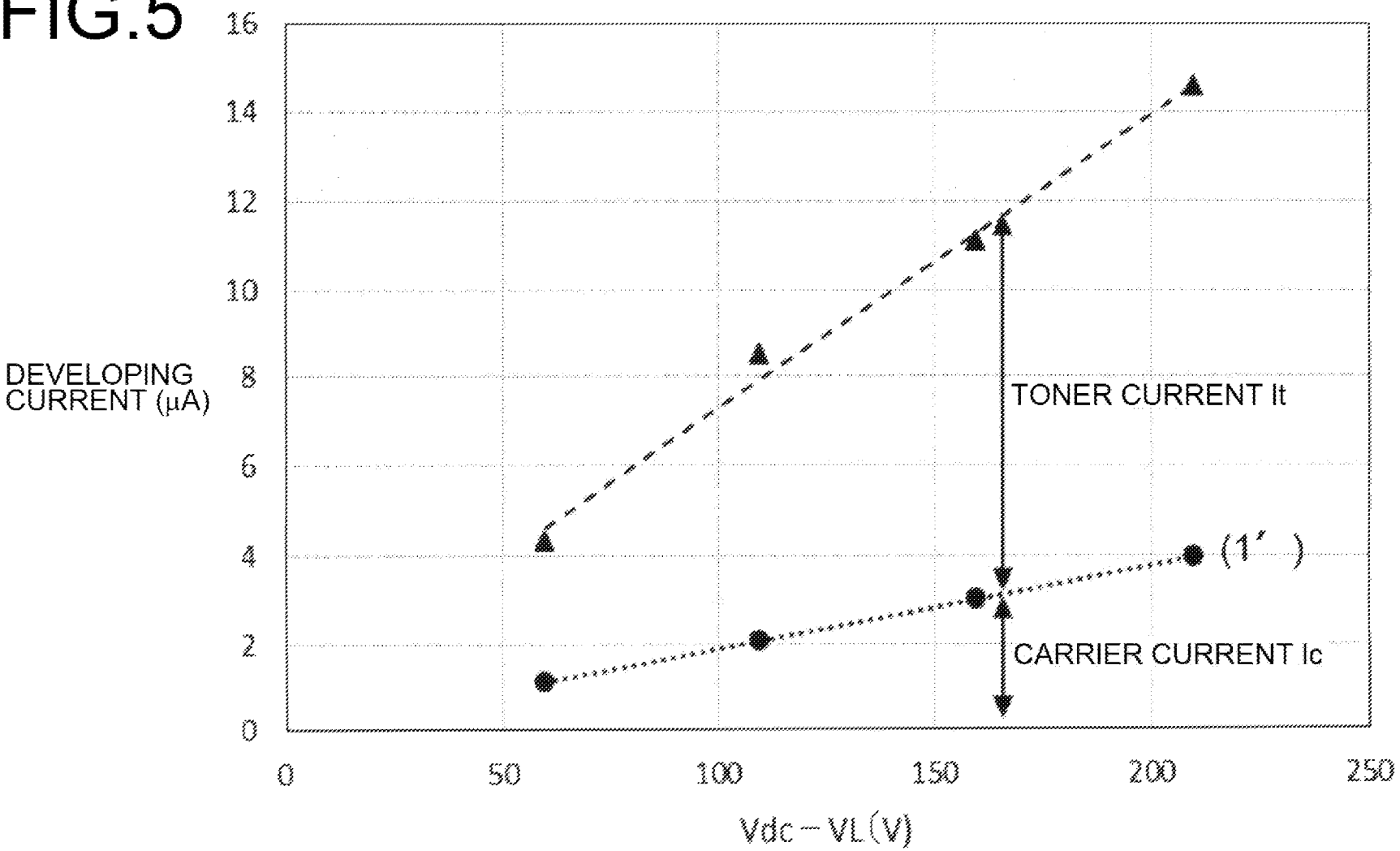
FIG. 5 is a graph illustrating the relationship between the developing current Id and the carrier current Ic that flow when the developing potential difference Vdc−VL between the DC component Vdc of the developing voltage and the exposed portion potential VL is changed.

FIG. 5 is a graph illustrating the relationship between the developing current Id and the carrier current Ic that flow when the developing potential difference Vdc−VL between the DC component Vdc of the developing voltage and the exposed portion potential VL is changed. As illustrated in FIG. 5, in the exposed portion (image portion), the developing current Id flows from the developing roller 31 side to the photoconductor drums 1*a* to 1*d* side. Therefore, using the Approximation Equation (1') obtained by reversing the Approximation Equation (1) illustrated in FIG. 4 to the plus side, the carrier current Ic predicted to flow with the developing potential difference Vdc−VL at the time of forming the reference image is obtained.

$$y=0.0189x-0.7665 \quad (1')$$

Then, the toner current It is calculated by subtraction from the developing current Id (indicated by the broken line in FIG. 5) that actually flows when the reference image is formed.

Here, I (current)=Q (charge)/t (time), so the toner transfer charge amount Qt is calculated based on the toner current It. Moreover, the toner developing amount m is calculated from the image density of the reference image detected by the image density sensor 40. The toner charge amount (=Qt/m) may be calculated using the calculated Qt and m.

As described above, the correlation between the developing potential difference V0−Vdc of the non-exposed portion (white background portion) and the developing current Id (=carrier current Ic) is acquired. Then, the carrier current Ic predicted to flow in the developing potential difference Vdc−VL when forming the reference image is calculated and subtracted from the developing current Id when the reference image is formed. As a result, the toner current It may be calculated accurately.

By using the toner charge amount calculated as described above, it is possible to identify the cause of a decrease in the carrier life and the image density. In other words, in a case where it is confirmed that the toner charge amount increases or decreases, the toner may be appropriately supplied to the developing devices 3*a* to 3*d* and consumed, and the developer in the developing devices 3*a* to 3*d* may be appropriately aged. In addition, the deterioration state of the carrier can be known by finding the change over time of the toner charge amount, and by predicting a decrease in the toner charge amount and by changing the target value of the toner concentration in the developer, or by changing the AC voltage of the developing voltage, it is possible to suppress the generation of development ghosts and transfer memory. Moreover, the timing of the next measurement of the toner charge amount may be optimized in accordance with the prediction of the change over time of the toner charge amount. Furthermore, by adjusting the primary transfer voltage, it is also possible to suppress a decrease in image density due to transfer failure.

A case will also be described in which developing devices 3*a* to 3*d* are used that have a mechanism in which a certain amount of carrier is mixed with the toner in advance, and together with supplying toner containing the carrier according to the consumption of the toner, discharge the excess developer. In this case, when the toner charge amount is significantly reduced, the toner is forcibly ejected to actively replace the carrier in the developing devices 3*a* to 3*d*. Accordingly, it is possible to suppress a decrease in the toner charge amount due to deterioration of the carrier. Furthermore, this may also be used for predicting the replacement time of the developing devices 3*a* to 3*d*.

Figure 6:
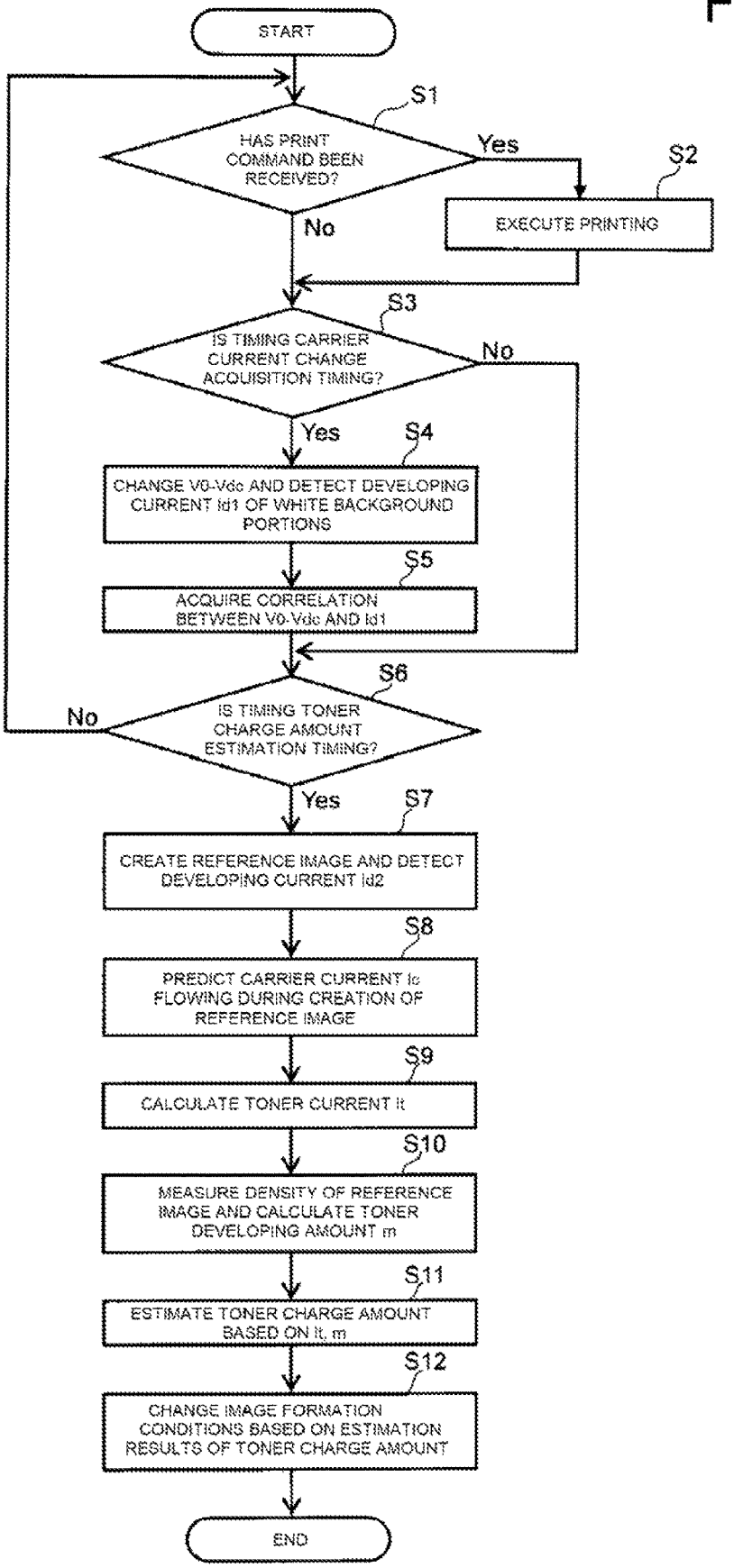
FIG. 6 is a flowchart illustrating an example of estimation control of the toner charge amount in the image forming apparatus 100 of the present embodiment.

FIG. 6 is a flowchart illustrating an example of estimation control of the toner charge amount in the image forming apparatus 100 of the present disclosure. First, the main control unit 80 determines whether or not a print command has been received (step S1). In a case where a print command has been received (YES in step S1), printing is executed by a normal image forming operation (step S2). In a case where the print command is not transmitted (NO in step S1), the main control unit 80 determines whether or not the timing is the acquisition timing for acquiring the carrier current change (step S3). Examples of the acquisition timing of the carrier current change include a case where the cumulative number of prints since the previous acquisition is a specific number (50 k to 100 k) or more, and the like.

When the timing is the acquisition timing of the carrier current change (YES in step S3), the developing potential difference V0−Vdc is changed to detect the developing current Id1 flowing when the developing roller 31 faces the white background portion (step S4). Then, the correlation between the measured Id1 and V0−Vdc is acquired (step S5), and the Approximation Equation (1) as illustrated in FIG. 4 is created. Note that in a case where the estimation timing for estimating the toner charge amount, which will be described later, is reached by the time the first carrier current change is acquired, the measurement is performed when the image forming apparatus 100 is assembled, and the carrier current change stored in the storage unit 70 is read out and used.

Next, the main control unit 80 determines whether or not the timing is the estimation timing for estimating the toner charge amount (step S6). Examples of the estimation timing for estimating the toner charge amount include, for example, a case where, at the end of the printing operation, the cumulative number of prints since the previous estimation of the toner charge amount is equal to or greater than a specific number, and the like. In a case where the timing is not the estimation timing for estimating the toner charge amount (NO in step S6), the process returns to step S1 and the standby state of for waiting for a print command is continued.

In a case where the timing is the estimation timing for estimating the toner charge amount (YES in step S6), the estimation mode for estimating the toner charge amount is started. More specifically, after the surfaces of the photoconductor drums 1*a* to 1*d* are charged by the charging devices 2*a* to 2*d*, the exposing device 5 forms electrostatic latent images of a reference image on the photoconductor drums 1*a* to 1*d*. Then, the developing voltage is applied to the developing roller 31 by the developing voltage power supply 43 to develop the electrostatic latent images into toner images. As a result, reference images are formed on the photoconductor drums 1*a* to 1*d*. Together with this, the current detecting unit 44 detects the developing current Id2 flowing through the developing roller 31 (step S7).

The main control unit 80 predicts the carrier current Ic flowing during the formation of the reference image having the developing potential difference Vdc−VL by using Approximation Equation (1') obtained by reversing the Approximation Equation (1) created in step S5 to the plus side. (Step S8). Moreover, the toner current It is calculated by Id2−Ic (step S9).

Next, a specific primary transfer voltage is applied to the primary transfer rollers 6*a* to 6*d* in order to transfer the reference image onto the intermediate transfer belt 8. Then, the density of each reference image is detected by the image density sensor 40. The main control unit 80 calculates the toner developing amount m based on the detected density of the reference image (step S10). The toner developing amount m is calculated using the relationship between the image density and the toner developing amounts previously stored in the storage unit 70.

Note that, in order to improve the calculation accuracy of the toner developing amounts, it is preferable to increase the number of times the reference image is formed (n number) or change the density of the reference image in a plurality of steps. When changing the density of the reference image, preferably the entire surface of the photoconductor drums 1*a* to 1*d* is exposed by the exposing device 5. At the same time, preferably the potential difference V0−Vdc between the surface potential V0 of the photoconductor drums 1*a* to 1*d* and the developing voltage Vdc applied to the developing roller 31 is kept constant, and V0 and Vdc are changed.

As a result, carrier development at the end portion (edge portion) of the reference image may be suppressed. Furthermore, in a case where a dot-shaped image is formed by changing the printing rate, a high density portion is generated in the dot peripheral portion; however, by exposing the entire surface with the exposing device 5, the high density portion of the dot peripheral portion disappears, so it is possible to reduce error when converting the density of the reference image into the toner development amount.

The main control unit 80 estimates the toner charge amount (=Qt/m) based on the toner transfer charge amount Qt calculated from the toner current It detected in step S8 and the toner developing amount m calculated in step S9 (step S11).

The main control unit 80 changes the image formation conditions based on the estimation result of the toner charge amount (step S12), and ends the process. Examples of the image formation conditions to be changed include the toner concentration in the developing devices 3*a* to 3*d*, the Vpp of the AC component of the developing voltage, the developing potential difference V0−Vdc in the non-exposed area (white background area), the primary transfer voltage applied to the primary transfer rollers 6*a* to 6*d*, and the like.

More specifically, in a case where the toner charge amount is low, it becomes easy for development ghosts to occur, so the toner concentration is lowered and the toner charge amount is increased. Alternatively, the occurrence of development ghosts is suppressed by lowering Vpp or reducing V0−Vdc. Moreover, in a case where the toner charge amount is low, a decrease in image density due to transfer failure is suppressed by increasing the primary transfer voltage.

Further, a case where the toner charge amount is equal to or lower (or higher) than a fixed value, or in other words, a case where the toner charge amount is outside of a specific range will be described. In this case, an electrostatic latent image pattern (solid pattern) is formed on the photoconductor drums 1*a* to 1*d*, a developing voltage is applied to the developing roller 31, and the toner on the developing roller 31 is transferred to the photoconductor drums 1*a* to 1*d* (forced ejection). In a case where the toner charge amount is equal to or higher than a certain level, it is also effective to lengthen the aging (stirring) time of the developer in the developing devices 3*a* to 3*d*.

Then, the deteriorating state of the toner is displayed on the liquid crystal display unit 90 (see FIG. 3), and a prompt is given to prepare to replace the toner and to change the usage state. Furthermore, in a state where the toner charge amount is significantly reduced, a display requesting toner replacement is displayed on the liquid crystal display unit 90, and the operation of the image forming apparatus 100 is stopped.

According to the control example illustrated in FIG. 6, the developing potential difference V0−Vdc of the non-exposed portion (white background portion) is changed, and the developing current Id1 (=Ic) flowing in the non-exposed portion (white background portion) is detected to acquire the correlation between the developing potential difference and the carrier current Ic. Then, the carrier current Ic that flows due to the developing potential difference when the reference image is formed is predicted. The toner current It may then be calculated accurately by subtracting the predicted carrier current Ic from the developing current Id2 that flows when the reference image is formed. Then, the toner charge amount in the developing devices 3*a* to 3*d* may be accurately estimated based on the toner current It and the toner developing amount m calculated from the image density of the reference image.

Furthermore, by controlling the toner concentration, the developing voltage, and the transfer voltage in the developing devices 3*a* to 3*d* and by forcibly ejecting the toner based on the estimated toner charging amount, image defects such as development ghosts due to the change in the toner charge amount, image fogging, transfer failure and the like may be effectively suppressed.

In addition, the present disclosure is not limited to the above embodiment, and various changes may be made within a range that does not depart from the spirit of the present disclosure. For example, in the embodiment described above, the carrier current change with respect to the developing potential difference is acquired for each specific number of prints (50 k to 100 k sheets); however, acquisition of the carrier current change may also be performed every time the estimation timing for estimating the toner charge amount is reached. Moreover, after the carrier current change is acquired a plurality of times and the approximation equation is created, the carrier current change may be predicted from the approximate expression without measuring the carrier current.

Moreover, in the embodiment described above, a color printer as illustrated in FIG. 1 has been described as an example of the image forming apparatus 100; however, the present invention is not limited to a color printer, and other image forming apparatuses such as monochrome and color copiers, digital multifunction apparatuses, facsimiles and the like may be used. Hereinafter, the effects of the present disclosure will be described in more detail with reference to Examples.

Examples

The developing potential difference is changed to detect the developing current Id1 (=Ic) flowing in the non-exposed area (white background area) and to acquire the correlation between the developing potential difference and the carrier current Ic, and a verification test is conducted for estimating the toner charge amount in the developing devices 3*a* to 3*d*. This estimation is based on the toner current It calculated by subtracting the predicted value of the carrier current Ic from the developing current Id2 flowing at the time when the reference image is formed, and the toner development amount m calculated from the image density of the reference image. As the conditions of the testing machine, in the image forming apparatus 100 as illustrated in FIG. 1, the photoconductor drums 1*a* to 1*d* having an amorphous silicon (a-Si) photosensitive layer are used, the potential of the non-exposed part is taken to be V0=270V, and the potential of the exposed part is taken to be VL=20V. Moreover, the linear speed of the drums (processing speed) in the full-speed mode is set to 55 sheets/min.

The developing devices 3*a* to 3*d* use a developing roller 31 having a diameter of 20 mm in which 80 rows of recesses are formed in the circumferential direction by knurling, and uses a 1.5 mm thick magnetic blade made of stainless steel (SUS430) as the regulating blade 27. The amount of developer conveyed by the developing roller 31 is set to 250 g/m$^2$. The peripheral speed ratio between the developing roller 31 and the photoconductor drums 1*a* to 1*d* is set to 1.8 (trail rotation at the opposite position), and the distance between the developing roller 31 and the photoconductor drums 1*a* to 1*d* is set to 0.30 mm. A voltage obtained by superimposing a rectangular wave AC voltage having a frequency of 4.2 kHz and a Duty=50% onto a 170 V DC voltage Vslv (DC) as a developing voltage is applied to the developing roller 31.

Moreover, a two-component developer composed of a positively charged toner having an average particle diameter of 6.8 μm and a ferrite/resin coat carrier having an average particle diameter of 35 μm is used, and the toner concentration is set to 8%.

As a test method, the toner charge amount is estimated by using the developing current Id2 flowing at the time of forming the reference image as the toner current It. In this case (before correction), the value obtained by subtracting the predicted value of the carrier current Ic from the developing current Id2 is defined as the toner current It. Then, a case where the toner charge amount is estimated (after correction) is compared with the measured value of the toner charge amount. The estimation results of the toner charge amount are listed in Table 1 together with the measured values of the toner charge amount.

TABLE 1

| TONER CHARGE AMOUNT [μC/g] | | |
|---|---|---|
| BEFORE CORRECTION | AFTER CORRECTION | MEASURED VALUE (*) |
| 37.9 | 27.9 | 27.6 |

(*) Measured using a suction-type compact charge amount measuring device (212HS, manufactured by Trek)

As illustrated in Table 1, the toner charge amount before correction estimated by using the developing current Id2 as the toner current It is 37.9 μC/g. On the other hand, the corrected toner charge amount estimated by subtracting the predicted value of the carrier current Ic from the developing current Id2 as the toner current It is 27.9 μC/g.

Moreover, the toner charge amount of the developer on the developing roller that is measured using a suction-type compact charge amount measuring device (212HS, manufactured by Trek) is 27.6 μC/g, which is a good match with the corrected toner charge amount. From the above, it is confirmed that the toner charge amount may be estimated accurately by using this estimation method.

In a method of a typical technique, a surface potential sensor is required to measure the surface potential, which leads to an increase in cost. In addition, in order to acquire the surface potential of the toner layer, it is necessary to install the surface potential sensor on the downstream side of the developing region with respect to the drum rotation direction. However, when the surface potential sensor is installed at this position, the surface of the surface potential sensor becomes easily contaminated with the scattered toner from the developing device, and it becomes impossible to measure the surface potential with high accuracy over a long period of time.

Moreover, in a method of another typical technique, there is a problem that the developing current includes not only the current flowing due to the movement of the toner (toner current) but also the current flowing through the carrier (carrier current). When the carrier current is a constant value, the developing current may be shifted by the amount of the carrier current measured in advance; however, durable printing causes scraping and contamination of the coat layer of the carrier, and the carrier resistance value changes, so the carrier current also changes. As a result, the toner current may not be measured correctly by only measuring the developing current.

In view of the problems described above, an object of the present disclosure is to provide an image forming apparatus capable of measuring a toner current included in a developing current with a simple configuration, and capable of accurately calculating a toner charge amount based on the measurement result.

With a first configuration according to the present disclosure, the toner current can be calculated accurately by subtracting the carrier current from the developing current that flows when the reference image is formed. Then, by estimating the toner charge amount based on the calculated toner current and the toner developing amount calculated from the density of the reference image, the toner charge amount may be estimated accurately, and based on the estimated toner charge amount, it is possible to identify the cause of a decrease in the carrier life and in the image density.

The technique according to the present disclosure may be applied to an image forming apparatus using a two-component developer that includes a toner and a carrier. By utilizing the technique according to the present disclosure, it is possible to provide an image forming apparatus capable of suppressing image defects by accurately estimating the toner charge amount and determining image formation conditions based on the estimation result.

What is claimed is:

1. An image forming apparatus, comprising:

an image forming unit that comprises:

an image carrier having a photosensitive layer formed on the surface thereof, a charging device that charges the image carrier;

an exposing device that forms an electrostatic latent image by exposing the image carrier charged by the charging device; and a developing device that has a developer carrier arranged facing the image carrier and carrying a two-component developer that includes a magnetic carrier and toner, and forms a toner image by adhering the toner to the electrostatic latent image formed on the image carrier;

a developing voltage power supply that applies a developing voltage obtained by superimposing an AC voltage on a DC voltage on the developer carrier;

a density detecting device that detects a density of the toner image formed by the developing device;

a current detecting unit that detects a DC component of a developing current that flows when the developing voltage is applied to the developer carrier; and a control unit that controls the image forming unit and the developing voltage power supply;

the control unit, by the developing device at a time of non-image formation, forms a reference image on the image carrier; by a current detecting unit, detects the developing current when the reference image is formed; calculates a toner current flowing due to movement of the toner by subtracting a carrier current flowing through the magnetic carrier from the detected developing current;

calculates a toner developing amount when the reference image is formed from a density of the reference image detected by the density detecting device; and estimates the toner charge amount based on the toner current and the toner developing amount.

2. The image forming apparatus according to claim 1, wherein the control unit changes the developing potential difference V0−Vdc between a surface potential V0 of the image carrier and a DC component Vdc of the developing voltage applied to the developer carrier in a plurality of steps; detects a DC component of the developing current flowing through the developer carrier when facing a non-exposed portion of the image carrier as the carrier current; and using an approximation equation obtained from correlation between the V0−Vdc and the carrier current, estimates the carrier current that flows when the reference image is formed.

3. The image forming apparatus according to claim 1, wherein the control unit changes image formation conditions based on an estimated toner charge amount.

4. The image forming apparatus according to claim 3, wherein when the toner charge amount is lower than a specific value, the control unit lowers a toner concentration in the developing apparatus, or lowers Vpp of an AC component of the developing voltage, or reduces a developing potential difference V0−Vdc between a surface potential V0 of the image carrier and a DC component Vdc of the developing voltage.

5. The image forming apparatus according to claim 3, further comprising a transfer member that is arranged facing the image carrier and that transfers the toner image formed on the image carrier to a subject to transfer; wherein when the toner charge amount is lower than a specific value, the control unit increases the transfer voltage applied to the transfer member.

6. The image forming apparatus according to claim 1, wherein when an estimated toner charge amount is outside of a specified range, the control unit performs a forced ejection operation for ejecting the toner inside the developing device to the image carrier.

* * * * *